US010957301B2

(12) United States Patent
Hoby et al.

(10) Patent No.: US 10,957,301 B2
(45) Date of Patent: Mar. 23, 2021

(54) HEADSET WITH ACTIVE NOISE CANCELLATION

(71) Applicant: GN AUDIO A/S, Ballerup (DK)

(72) Inventors: Michael Hoby, Ballerup (DK); Christoffer Bovbjerg, Ballerup (DK)

(73) Assignee: GN AUDIO A/S, Ballerup (DK)

( * ) Notice: Subject to any disclaimer, the term of this patent is extended or adjusted under 35 U.S.C. 154(b) by 0 days.

(21) Appl. No.: 16/821,864

(22) Filed: Mar. 17, 2020

(65) Prior Publication Data

US 2020/0320972 A1 Oct. 8, 2020

(30) Foreign Application Priority Data

Apr. 3, 2019 (DK) ..... PA 2019 00412

(51) Int. Cl.
*H04R 1/10* (2006.01)
*G10K 11/178* (2006.01)

(52) U.S. Cl.
CPC ..... *G10K 11/17853* (2018.01); *H04R 1/1016* (2013.01); *G10K 2210/1081* (2013.01); *H04R 2460/01* (2013.01)

(58) Field of Classification Search
CPC ..... G10K 2210/1081; G10K 11/17853; H04R 1/1083; H04R 2410/05; H04R 1/1016; H04R 2460/01

(Continued)

(56) References Cited

U.S. PATENT DOCUMENTS 9,620,101 B1 * 4/2017 Thandri ..... H02M 3/07
10,586,523 B1 * 3/2020 Kohler ..... G10K 11/17833
(Continued)

FOREIGN PATENT DOCUMENTS

WO 2010129219 A1 11/2010
WO 2014070836 A2 5/2014

OTHER PUBLICATIONS

Search Report issued in Danish Patent Application No. PA2019 00412, dated Oct. 8, 2019, 9 pages provided.

*Primary Examiner* — Thjuan K Addy
(74) *Attorney, Agent, or Firm* — Hamre, Schumann, Mueller & Larson, P.C.

(57) ABSTRACT

The earphone (1) is adapted to be arranged in an operating position at a first ear (5) of a user (4) and, in the operating position, provide a first acoustic output signal ($S_O$) to the first ear (5). The earphone has a first input unit (31) adapted to receive a first audio input signal ($S_I$); a first noise cancellation signal path (37) with a first microphone (26) and a first noise cancellation filter (32), wherein the first microphone (26) is arranged to receive ambient sound ($S_A$) from ambient space (7) with the earphone in the operating position and is adapted to provide a corresponding first reference signal ($S_R$), and wherein the first noise cancellation filter (32) is adapted to apply a first transfer function (H) to the first reference signal ($S_R$) to provide a first noise cancellation signal ($S_C$).

14 Claims, 5 Drawing Sheets

(58) Field of Classification Search
USPC ... 381/71.6, 71.1, 312, 317, 73.1, 94.1, 71.7
See application file for complete search history.

(56) References Cited

U.S. PATENT DOCUMENTS

| | | | | |
|---|---|---|---|---|
| 2009/0034748 | A1 | 2/2009 | Sibbald | |
| 2009/0245529 | A1* | 10/2009 | Asada | G10K 11/17875 381/71.6 |
| 2010/0266137 | A1 | 10/2010 | Sibbald et al. | |
| 2010/0272279 | A1 | 10/2010 | Joho et al. | |
| 2010/0272280 | A1 | 10/2010 | Joho et al. | |
| 2015/0296297 | A1 | 10/2015 | Hua et al. | |
| 2018/0176672 | A1 | 6/2018 | Adkins | |
| 2018/0350340 | A1 | 12/2018 | Kumar et al. | |
| 2019/0130928 | A1 | 5/2019 | Rule et al. | |

* cited by examiner

HEADSET WITH ACTIVE NOISE CANCELLATION

TECHNICAL FIELD

The present invention relates to an earphone with active noise cancellation and to a headset with such an earphone. The invention may e.g. be used to reduce noise perceived by a user while listening to speech or music through an active noise cancellation earphone and/or to improve the comfort perceived by the user when using an active noise cancellation headset in low-noise environments.

BACKGROUND ART

In the prior art, earphones and headsets with active noise cancellation (ANC)—sometimes called active noise reduction (ANR)—are known that provide acoustic output signals that counteract ambient sound, such that the level of ambient sound arriving at the ear of the user is reduced.

International Patent Application WO 2014070836 A2 discloses an ANR headphone that includes an ear cup configured to couple to a wearer's ear to define an acoustic volume including the volume of air within the wearer's ear canal and a volume within the ear cup, a feed-forward microphone acoustically coupled to an external environment and electrically coupled to a feed-forward active noise cancellation signal path, a feed-backward microphone acoustically coupled to the acoustic volume and electrically coupled to a feed-backward active noise cancellation signal path, an output transducer acoustically coupled to the acoustic volume via the volume within the ear cup and electrically coupled to both the feed-forward and feed-backward active noise cancellation signal paths, and a signal processor configured to apply filters and control gains of both the feed-forward and feed-backward active noise cancellation signal paths. The signal processor is configured to apply first feed-forward filters to the feed-forward signal path and apply first feed-backward filters to the feed-backward signal path during a first operating mode providing effective cancellation of ambient sound, and to apply second feed-forward filters to the feed-forward signal path during a second operating mode providing active hear-through of ambient sounds with ambient naturalness. The signal processor may be further configured to apply second feed-backward filters different from the first feed-backward filters to the feed-backward signal path during the second operating mode. The signal processor may be further configured to apply third feedforward filters to the feed-forward signal path during a third operating mode providing active hear-through of ambient sounds with a different total response than may be provided in the second operating mode. A user input may be provided, with the signal processor configured to select between the first, second, or third feed-forward filters based on the user input. The user input may include a volume control. The signal processor may be configured to select between the second and third feed-forward filters automatically. The signal processor may be configured to select between the second and third feed-forward filters based on a time-average measurement of the level of the ambient noise. The feed-backward system may be used to automatically turn on active hear-through when it detects that the user starts speaking to provide self-naturalness of the user's voice.

A problem often encountered with ANC earphone and headsets, is that the ANC system itself may produce noise that the users may perceive as annoying in quiet environments. The above-mentioned prior art document does not address this problem, which thus still needs to be solved.

Furthermore, some users may feel isolated from their environment in the absence of ambient sound. The above-mentioned prior art document suggests keeping active hear-through enabled while listening to music to overcome this problem. This still leaves room for other solutions.

International Patent Application WO 2010/129219 A1 discloses an ANR circuit using filters whose transfer function is dynamically and continuously modified by an algorithm for analyzing the signal in real time. An external microphone placed on the casing of the headset earphones collects the ambient noises, whose level is analyzed to adjust the transfer function of the feed-backward filter. A drawback of the disclosed solution lies in that the feed-backward ANC does not adapt to the noise really perceived by the user, but to the noise existing in the external environment of the headset, which eventually may cause an increase of the noise perceived by the user. The application further discloses that the ANR circuit may reduce the degree of feedforward-based ANR that it provides in response to receiving an indication of the operation of a manually-operable control. The reduction of degree of feedforward-based ANR may be effected by turning off or otherwise deactivating the provision of feedforward-based ANR, reducing a range of frequencies of environmental noise sounds attenuated by the feedforward-based ANR to provide less attenuation of sounds detected by a feedforward microphone that are in a range of frequencies deemed to be those of human speech, and/or creating a notch in the range of frequencies of environmental noise sounds attenuated by the feedforward-based ANR to provide less attenuation of sounds detected by the feedforward microphone that are in a range of frequencies deemed to be those of human speech. The application does not address the isolation problem, neither do the disclosed measures solve it.

Patent Application US 2015 296297 A1 discloses an ANC headset with a closed-loop feed-backward branch with a feed-backward ANC filter that is switchable among a plurality of preconfigured feed-backward ANC filters, based on analysis of a signal from an internal ANC microphone. While the solution disclosed may reduce noise produced by the ANC system itself, it is, however, also relatively complex and e.g. requires the provision of a switchable equalizer. The application does not address the isolation problem.

DISCLOSURE OF INVENTION

It is an object of the present invention to provide an improved earphone with active noise cancellation and without some disadvantages of prior art apparatuses. It is a further object of the present invention to provide a headset with such an earphone and with similar advantages.

These and other objects of the invention are achieved by the invention defined in the independent claims and further explained in the following description. Further objects of the invention are achieved by embodiments defined in the dependent claims and in the detailed description of the invention.

Within this document, the singular forms "a", "an", and "the" specify the presence of a respective entity, such as a feature, an operation, an element or a component, but do not preclude the presence or addition of further entities. Likewise, the words "have", "include" and "comprise" specify the presence of respective entities, but do not preclude the presence or addition of further entities. The term "and/or" specifies the presence of one or more of the associated entities. The steps or operations of any method disclosed herein need not be performed in the exact order disclosed, unless expressly stated so.

BRIEF DESCRIPTION OF THE DRAWINGS

The invention will be explained in more detail below together with preferred embodiments and with reference to the drawings in which.

The figures are schematic and simplified for clarity, and they just show details essential to understanding the invention, while other details may be left out. Where practical, like reference numerals and/or labels are used for identical or corresponding parts.

MODE(S) FOR CARRYING OUT THE INVENTION

Figure 1:
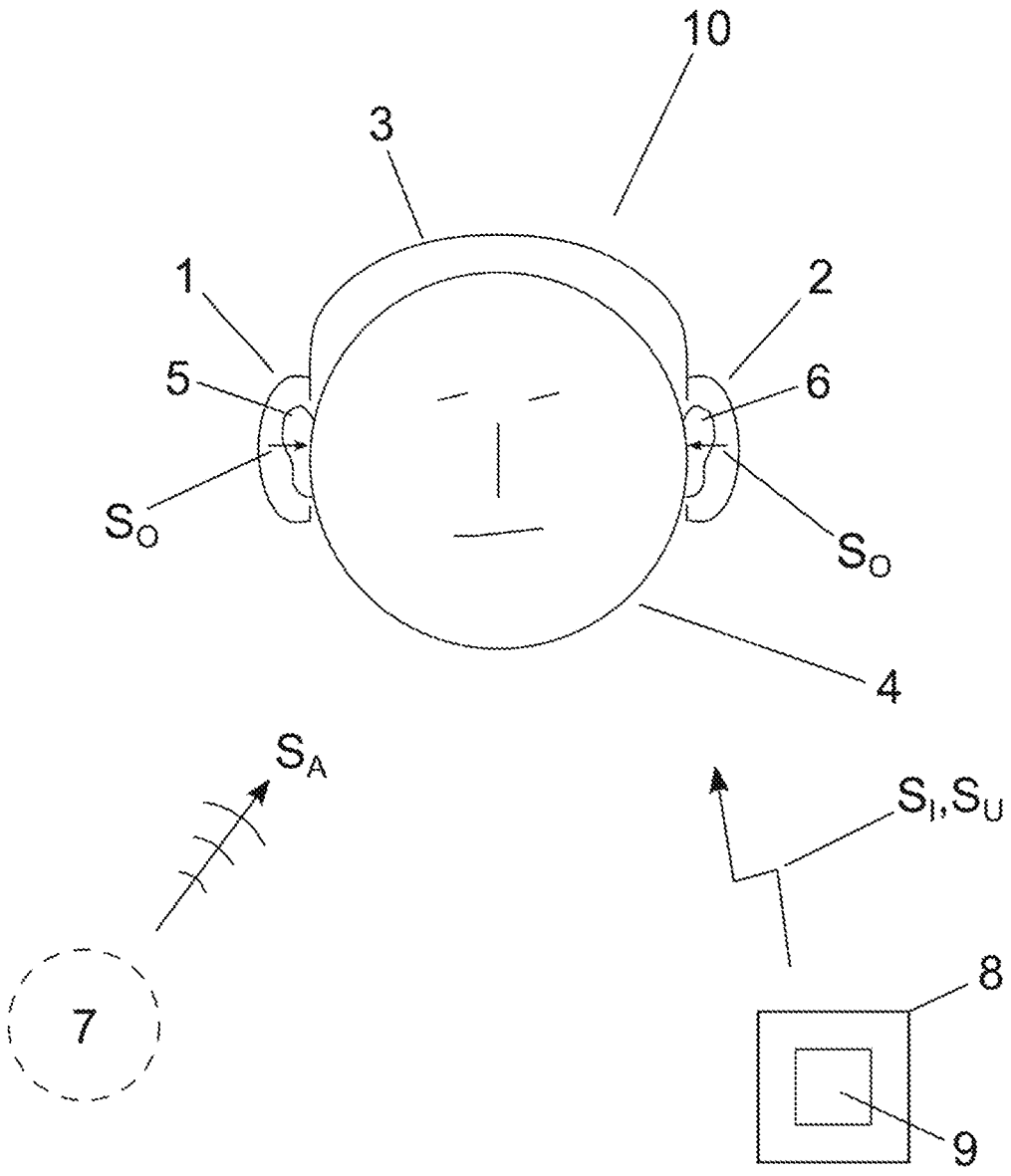
FIG. 1 shows an embodiment of a headset according to the invention.

The present invention relates to an earphone with active noise cancellation and to a headset with such an earphone.

The earphone (1) is adapted to be arranged in an operating position at a first ear (5) of a user (4) and, in the operating position, provide a first acoustic output signal ($S_O$) to the first ear (5). The earphone comprises: a first input unit (31) adapted to receive a first audio input signal ($S_I$); a first noise cancellation signal path (37) with a first microphone (26) and a first noise cancellation filter (32), wherein the first microphone (26) is arranged to receive ambient sound ($S_A$) from ambient space (7) with the earphone in the operating position and is adapted to provide a corresponding first reference signal ($S_R$), and wherein the first noise cancellation filter (32) is adapted to apply a first transfer function (H) to the first reference signal ($S_R$) to provide a first noise cancellation signal ($S_C$); a first output unit (33) adapted to provide a first audio output signal ($S_D$) by combining the first audio input signal ($S_I$) and the first noise cancellation signal ($S_C$); a first electroacoustic transducer (23) adapted to provide the first acoustic output signal ($S_O$) in dependence on the first audio output signal ($S_D$); and a first noise cancellation controller (34) adapted to adaptively control the first transfer function (H) of the first noise cancellation filter (32) to cause the first acoustic output signal ($S_O$) to counteract ambient sound ($S_A$), such that, with the earphone in the operating position, the level of ambient sound ($S_A$) arriving at the first ear (5) is reduced, while still allowing desired sound from the first audio input signal ($S_I$), to pass through.

The earphone (1) is characterized in that it further comprises a level analyzer (35) adapted to provide, based on an analysis of the first audio input signal ($S_I$) and/or the first reference signal ($S_R$), a sound level estimate ($L_S$) indicating a total sound level at the first ear (5) and to compare the sound level estimate ($L_S$) with a predetermined threshold ($L_T$) indicating a noise floor level; and in that the first noise cancellation controller (34) further is adapted to, in dependence on the comparison, control the wide-band gain (G) of the first noise cancellation signal path (37) to cause a decrease (ΔG) of the wide-band gain (G) in time periods wherein the total sound level at the first ear (5) is below the noise floor level compared to time periods wherein the total sound level at the first ear (5) is above the noise floor level.

The invention may e.g. be used to reduce noise perceived by a user while listening to speech or music through an active noise cancellation earphone and/or to improve the comfort perceived by the user when using an active noise cancellation headset in low-noise environments.

The headset 10 in FIG. 1 comprises a first earphone 1, a second earphone 2 and a headband 3 mechanically connecting the earphones 1, 2. The headset 10 is shown arranged on the head of a user 4 of the headset 10 with each of the earphones 1, 2 arranged in a respective operating position at a respective ear 5, 6 of the user 4. Ambient sound $S_A$ from the user's environment 7, i.e. ambient space, penetrates and/or circumvents the structure of the earphones 1, 2 towards the user's ears 5, 6. The headset 10 receives audio input signals $S_I$ from an external device 8, such as e.g. a headset base, a computer, a desktop phone and/or a mobile phone, and the earphones 1, 2 provide corresponding acoustic output signals $S_O$ to the respective ears 5, 6. The external device 8 may comprise a user interface 9 for detecting manipulation by the user 4 and may thus provide corresponding user input signals $S_U$ to the headset 10. The headset 10 further comprises structures and functional blocks enabling it to operate as an ANC headset that provides the acoustic output signals $S_O$ such that ambient sound $S_A$ is counteracted in a way that reduces the level of ambient sound $S_A$ arriving at the ears 5, 6 while still allowing desired sound, such as music or speech received in the audio input signals $S_I$, to pass through.

Figure 2:
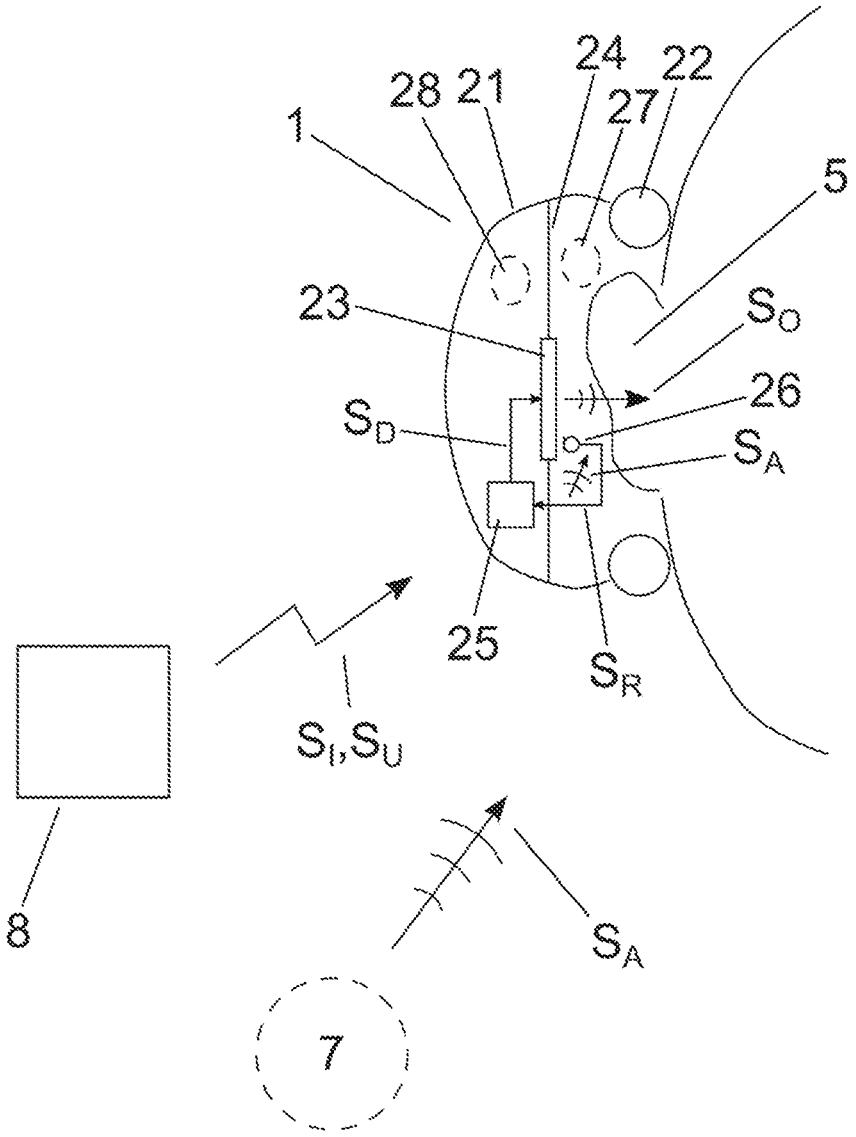
FIG. 2 shows an embodiment of an earphone according to the invention.

FIG. 2 shows details of an embodiment of an earphone 1, such as the first earphone 1 and/or the second earphone 2 of the headset 10 of FIG. 1. The earphone 1 comprises a housing 21, an ear cushion 22, an electroacoustic transducer 23 suspended in a baffle 24, a signal processor 25, and a feed-backward microphone 26. The earphone 1 is shown arranged in an operating position at an ear 5 of the user 4. The housing 21 and the ear cushion 22 are configured to separate a front cavity 27 from ambient space 7 when the earphone 1 is in the operating position. The electroacoustic transducer 23 is adapted to radiate an acoustic output signal $S_O$ into the front cavity 27 and thus provide it to the ear 5. The baffle 24 separates the front cavity 27 from a rear cavity 28 to reduce acoustic shorting of the electroacoustic transducer 23. The feed-backward microphone 26 is arranged with a sound inlet (not shown) close to a sound-producing element (not shown) of the electroacoustic transducer 23 to enable an accurate pick-up of the acoustic output signal $S_O$ radiated by the electroacoustic transducer 23. The feed-backward microphone 26 further picks up residual ambient sound $S_A$ arriving at its sound inlet and provides a feed-backward reference signal $S_R$ in dependence on the sum of the picked-up signals $S_O$, $S_A$. The signal processor 25 receives an audio input signal $S_I$, e.g. from an external device 8, and the feed-backward reference signal $S_R$ from the feed-backward microphone 26, processes these signals and provides a resulting audio output signal $S_D$ to the electroacoustic transducer 23, which provides the acoustic output signal $S_O$ in dependence on the audio output signal $S_D$. The signal processor 25 may further receive a user input signal $S_U$ from an external device 8 and provide the audio output signal $S_D$ in further dependence on the user input signal $S_U$. In some embodiments, the reception of the user input signal $S_U$ may be omitted.

The earphone 1 further comprises structures and functional blocks (see FIG. 3) enabling it to operate as an ANC earphone that provides the acoustic output signal $S_O$ such that, with the earphone 1 in the operating position, ambient sound $S_A$ is counteracted in a way that reduces the level of ambient sound $S_A$ arriving at the ear 5 while still allowing desired sound, such as music or speech received in the audio input signal $S_I$, to pass through. The feed-backward microphone 26 thereby functions as reference microphone for the feed-backward noise cancellation system of the earphone 1.

The operating position of the earphone 1 may be any one of the operating positions known from prior art ANC earphones and headsets, such as e.g. an over-the-ear position, an on-the-ear position or an in-the-ear position. Correspondingly, the earphone 1—or a headset 10 comprising the earphone 1—may be configured for such positioning and may comprise any known type of wearing structure, such as a headband, a neckband, an ear hook, an ear wing or the like that assists the user in maintaining the earphone 1 or the headset 10 in an operating position wherein the ANC is effective. In some embodiments, the ear cushion 22 may be omitted or be replaced by an earbud or other acoustic dampening structure that attenuates ambient sound $S_A$ on its way towards the ear 5.

Figure 3:
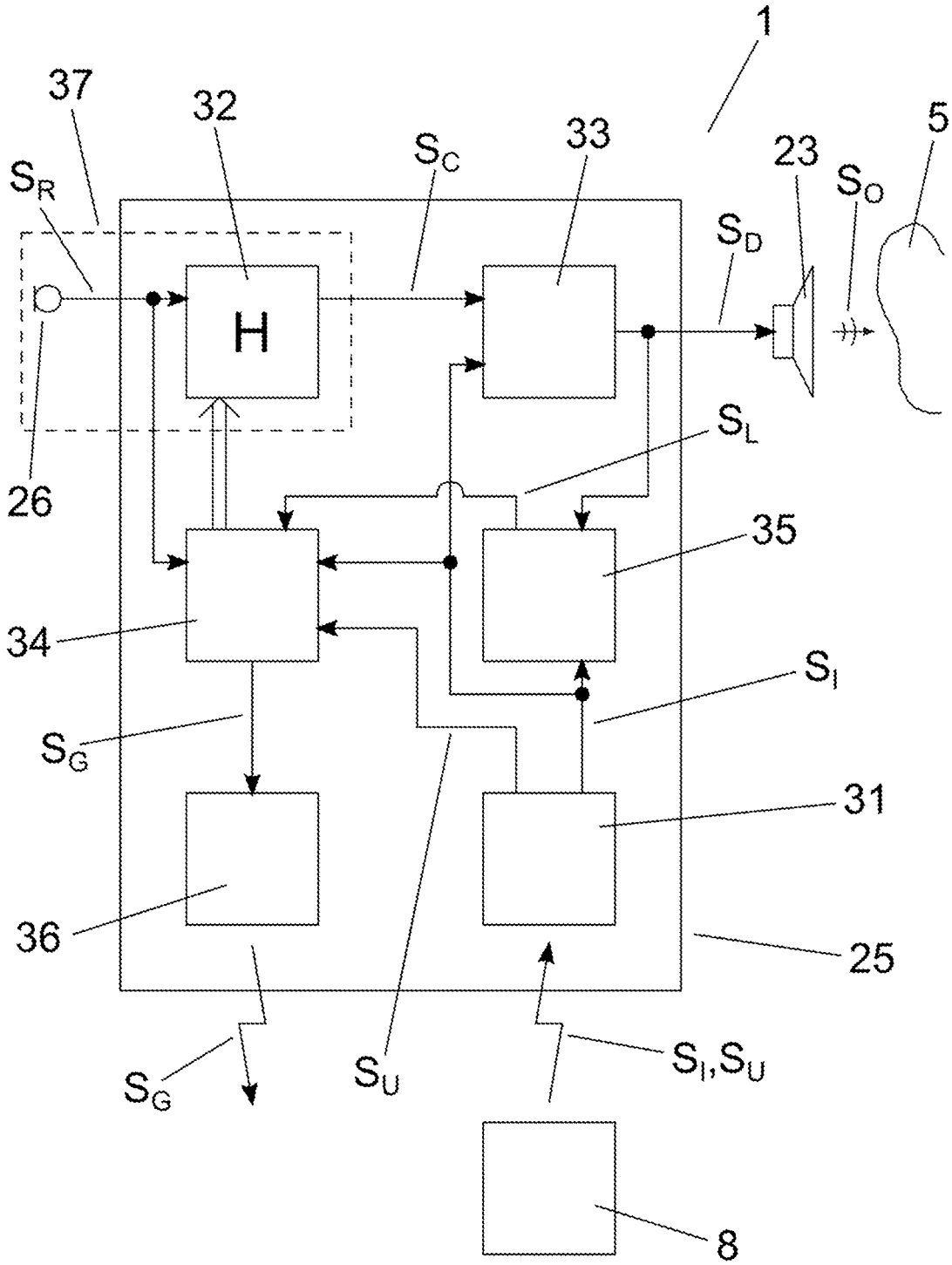
FIG. 3 shows details of an embodiment of an earphone according to the invention.

FIG. 3 shows a functional block schematic of the earphone 1 of FIG. 2 with further details. The signal processor 25 comprises an input unit 31, a feed-backward noise cancellation filter 32, an output unit 33, a noise cancellation controller 34, a level analyzer 35 and a transmitter 36. The input unit 31 receives the audio input signal $S_I$ and the user input signal $S_U$ from an external device 8 and provides these to the noise cancellation controller 34. The earphone 1 further comprises a feed-backward noise cancellation signal path 37 that comprises the feed-backward microphone 26 and the feed-backward noise cancellation filter 32. The feed-backward noise cancellation filter 32 applies a feed-backward transfer function H to the feed-backward reference signal $S_R$ from the feed-backward microphone 26 to provide a feed-backward noise cancellation signal $S_C$. The output unit 33 provides the audio output signal $S_O$ to the electroacoustic transducer 23 by combining the audio input signal $S_I$ and the feed-backward noise cancellation signal $S_C$. The noise cancellation controller 34 adaptively controls the feed-backward transfer function H to cause the acoustic output signal $S_O$ to counteract ambient sound $S_A$, such that, with the earphone 1 in the operating position, the level of ambient sound $S_A$ arriving at the ear 5 is reduced while still allowing desired sound, such as music or speech received in the audio input signal $S_I$, to pass through.

In general, a signal path, such as the feed-backward noise cancellation signal path 37, that applies a frequency-dependent transfer function to its input signal to provide its output signal, may be modelled by a wide-band amplifier in series with a frequency-dependent filter. In the present context, decreasing "the wide-band gain" of a signal path shall mean to modify the transfer function of that signal path in a way that, in the above-described model of the signal path, corresponds to decreasing the gain of the wide-band amplifier without modifying the frequency-dependent filter. Note that, for a given signal path, the choice of a starting value for the wide-band gain is arbitrary, since in the model, the transfer function of the frequency-dependent filter may be scaled to complement any choice of wide-band gain value.

Figure 4:
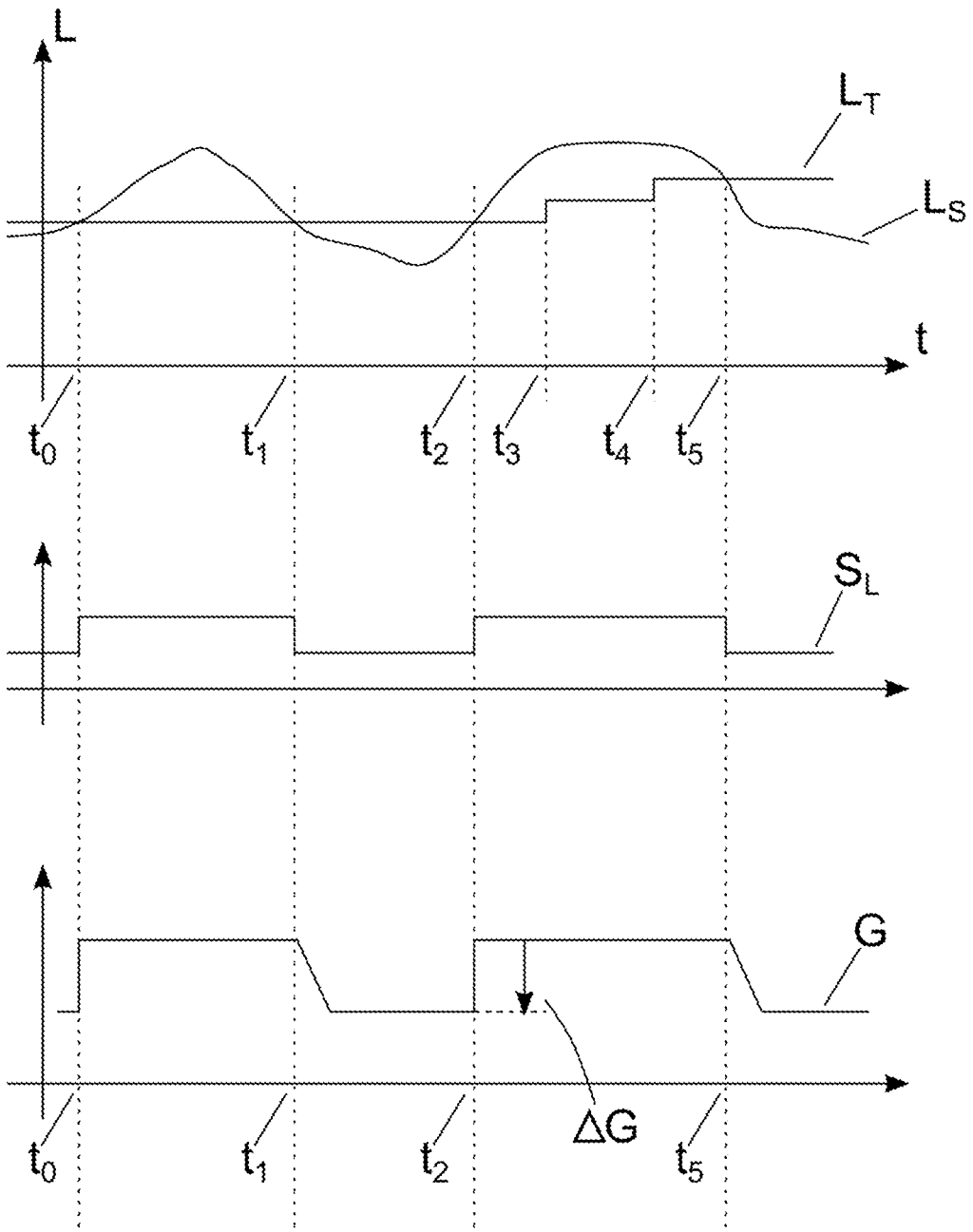
FIG. 4 illustrates functions of an earphone according to the invention.

FIG. 4 illustrates functions of the earphone 1 of FIGS. 2 and 3 and shows an example signal diagram with time t progressing rightwards. In the upper section, sound level L logarithmically increases upwards. The level analyzer 35 provides, based on an analysis of the audio input signal $S_I$ and/or the feed-backward reference signal $S_R$, a sound level estimate $L_S$ indicating a total sound level at the ear 5, compares the sound level estimate $L_S$ with a predetermined threshold $L_T$ indicating a noise floor level and provides the comparison result $S_L$, as illustrated in the middle section, to the noise cancellation controller 34. The noise cancellation controller 34 receives the comparison result $S_L$ and uses it to control the wide-band gain G of the feed-backward noise cancellation signal path 37, as illustrated in the lower section with wide-band gain G logarithmically increasing upwards, to cause a decrease ΔG of the wide-band gain G in time periods wherein the total sound level at the ear 5 (as indicated by the sound level estimate $L_S$) is below the noise floor level (as indicated by the predetermined threshold $L_T$) compared to time periods wherein the total sound level at the ear 5 is above the noise floor level. In the signal diagram, such time periods appear between $t_1$ and $t_2$ as well as after $t_5$. Conversely, the noise cancellation controller 34 uses the comparison result $S_L$ to cause an increase of the wide-band gain G in time periods wherein the total sound level at the ear 5 is above the noise floor level compared to time periods wherein the total sound level at the ear 5 is below the noise floor level. In the signal diagram, such time periods appear between to and $t_1$ as well as between $t_2$ and $t_5$. At times $t_3$ and $t_4$, increases of the predetermined threshold $L_T$ illustrate adjustments of the noise floor by the user which cause the decrease ΔG of the wide-band gain G at time $t_5$ to appear at a higher total sound level at the ear 5 than without those adjustments.

In the present context, the total sound level at the ear 5 shall be understood as the sound level arising from the combination of acoustic output signal $S_O$ arriving at the ear 5 and (residual) ambient sound $S_A$ arriving at the ear 5. In providing the sound level estimate $L_S$, the level analyzer 35 may thus use the feed-backward reference signal $S_R$ as an estimate of the total sound level at the ear 5. The level analyzer 35 may further refine such an estimate of the total sound level at the ear 5 using the audio input signal $S_I$, e.g. to separate the contributions of the acoustic output signal $S_O$ and the ambient sound $S_A$ and thus enable individual compensation for the different acoustic paths leading these sound contributions to the ear 5. The level analyzer 35 may further modify such sound contributions using estimated level differences between the location of the reference microphone 26 and the tympanic membrane of the ear 5, e.g. by design or by using estimates of level differences obtained using signals from multiple microphones.

Note that since the predetermined threshold $L_T$ is compared to the sound level estimate $L_S$ that indicates a total sound level at the ear 5, the effect will, simply put, be that ambient sound $S_A$ may arrive at the ear 5 unaffected by the active noise cancellation as long as the combination of the ambient sound $S_A$ and the portion of the audio output signal $S_O$ that is based on the audio input signal $S_I$ has a level at the ear 5 that is below the noise floor level. Conversely, when either of the ambient sound $S_A$ and the portion of the audio output signal $S_O$ that is based on the audio input signal $S_I$, or the combination thereof, has a level at the ear 5 that is above the noise floor level, then the ambient sound $S_A$ will be subject to active noise cancellation.

In some embodiments, the noise cancellation controller 34 may provide a gain control signal $S_G$ indicating a decrease ΔG of the wide-band gain G of the feed-backward noise cancellation signal path 37, and the transmitter 36 may transmit the gain control signal $S_G$ to another device, such as e.g. a respective other one of the first and second earphones 1, 2 of the headset 10. In other embodiments, the transmitter 36 may be omitted.

The noise cancellation controller 34 may preferably cause the decrease ΔG of the wide-band gain G to appear smoothly, e.g. over a time interval of at least 1 s, at least 5 s or at least 10 s, and to cause the increase of the wide-band gain G to appear significantly faster than the decrease ΔG of the wide-band gain, e.g. within a time interval of less than 200 ms, less than 100 ms, less than 50 ms or even less than 20 ms. A smooth decrease ΔG of the wide-band gain G may allow the user to hear low-level ambient sound $S_A$ only in pauses in the audio input signal $S_I$, which may comprise e.g. music or speech from a remote party in a telephone or network conversation. This may reduce the risk of low-level ambient sound $S_A$ disturbing such content in the audio input signal $S_I$ while at the same time reducing the acoustic isolation from the environment felt by the user 4. A fast increase of the wide-band gain G may, on the other hand, enable quick suppression of ambient sound $S_A$ when it gets louder.

The level analyzer 35 preferably performs the comparison such that it at least partly compensates for a frequency dependency and/or level dependency of the ear 5, e.g. by at least partly compensating for the frequency dependency of the average healthy human ear. The level analyzer 35 may e.g. perform such compensation by applying the well-known equal-loudness contours when providing the sound level estimate $L_S$. Alternatively, the level analyzer 35 may use hearing thresholds obtained for the current user 4 for the compensation. The level analyzer 35 may e.g. perform the compensation in the computation of the sound level estimate $L_S$ and/or in the comparison itself.

The decrease ΔG of the wide-band gain G in time periods wherein the total sound level at the ear 5 is below the noise floor level may cause the earphone 1 to allow more ambient sound $S_A$ to arrive at the ear 5 during such time periods while at the same time reducing the level of noise produced by the ANC system in the audio output signal $S_O$. The predetermined threshold $L_T$ may preferably be set to indicate a relative low noise floor level, such as within a range of 0 dB to 20 dB above the average healthy human hearing threshold, e.g. within a frequency range from 100 Hz to 1 kHz—or within a wider frequency range. In this case, the decrease ΔG of the wide-band gain G may decrease the noise level perceived by the user 4 in quiet environments. The increase of ambient sound $S_A$ arriving at the ear 5 may further reduce the acoustic isolation from the environment felt by the user 4.

The user input signal $S_U$ may comprise an indication of an action of the user 4, and the level analyzer 35 may preferably adjust the noise floor level indicated by the predetermined threshold $L_T$, based on the indicated action. The user input signal $S_U$ may e.g. comprise an indication of a first action of the user 4, and the level analyzer 35 may increase the indicated noise floor level in response to the indication of the first action. Conversely, the user input signal $S_U$ may comprise an indication of a second action of the user 4, and the level analyzer 35 may decrease the indicated noise floor level in response to the indication of the second action. This may allow the user 4 to adjust the level up to which ambient sound $S_A$ may arrive at the ear 5 with the earphone in the operating position and may thus allow the user 4 to balance noise cancellation and environment awareness according to personal preference. In some embodiments, the earphone 1 may comprise a user interface (not shown) that detects manipulation by the user 4 and provides a corresponding user input signal $S_U$ to the signal processor 25. In some embodiments, the earphone 1 and the signal processor 25 may receive a user input signal $S_U$ from an external device 8 with a user interface 9 that can be manipulated by the user 4.

The noise cancellation controller 34 may control the wide-band gain G of the feed-backward noise cancellation signal path 37 by modifying the gain of an amplifier (not shown) comprised by the feed-backward noise cancellation signal path 37 and arranged in series with the feed-backward noise cancellation filter 32. The noise cancellation controller 34 may thus set the gain of the amplifier equal to a first gain value when the comparison result $S_L$ indicates that the total sound level at the ear 5 is above the noise floor level and set it equal to a second gain value when the comparison result $S_L$ indicates that the total sound level at the ear 5 is below the noise floor level, wherein the second gain value equals the first gain value scaled by an amplifier scaling factor below unity. In this case, the decrease ΔG of the wide-band gain G equals the multiplicative inverse of the amplifier scaling factor.

Figure 5:
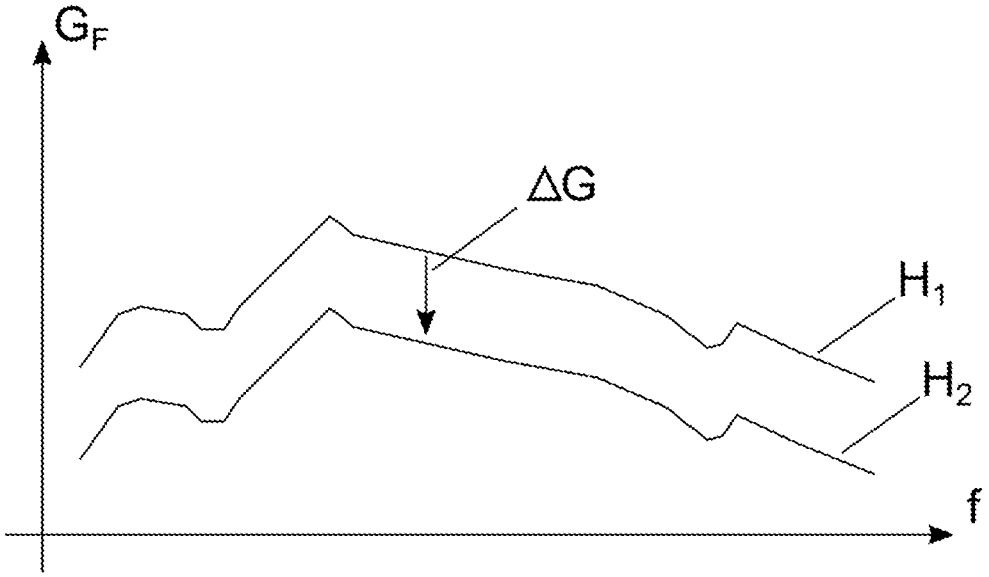
FIG. 5 shows example transfer functions of an earphone according to the invention.

FIG. 5 shows example transfer functions of the feed-backward transfer function H of the feed-backward noise cancellation filter 32 of an earphone of the earphone 1 of FIG. 2 with filter gain $G_F$ logarithmically increasing upwards and signal frequency f increasing rightwards. Alternatively, or additionally, to applying a scaling of an amplifier gain, the noise cancellation controller 34 may control the wide-band gain G of the feed-backward noise cancellation signal path 37 by scaling the feed-backward transfer function H. The noise cancellation controller 34 may thus set the feed-backward transfer function H equal to a first feed-backward transfer function $H_I$ when the comparison result $S_L$ indicates that the total sound level at the ear 5 is above the noise floor level and set it equal to a second feed-backward transfer function $H_2$ when the comparison result $S_L$ indicates that the total sound level at the ear 5 is below the noise floor level, wherein the second feed-backward transfer function $H_2$ equals the first feed-backward transfer function $H_I$ scaled by a filter scaling factor below unity. In the case that the noise cancellation controller 34 applies both a scaling of an amplifier gain and a scaling of the feed-backward transfer function H, then the decrease ΔG of the wide-band gain G equals the multiplicative inverse of the product of the amplifier scaling factor and the filter scaling factor, and in this case, one of the amplifier scaling factor and the filter scaling factor may be above unity, provided that their product is below unity. In the case that the noise cancellation controller 34 applies only a scaling of the feed-backward transfer function H, then the decrease ΔG of the wide-band gain G equals the multiplicative inverse of the filter scaling factor.

The level analyzer 35 may provide the comparison result $S_L$ such that it indicates the level difference between the total sound level at the ear 5 and the noise floor level, at least when they are close to each other, and the noise cancellation controller 34 may correspondingly apply a partial decrease ΔG of the wide-band gain G when the total sound level at the ear 5 is above the noise floor level by a smaller amount, and the full decrease ΔG of the wide-band gain G only when the total sound level at the ear 5 is above the noise floor level by a larger amount. The noise cancellation controller 34 may further, or alternatively, apply a hysteresis in the activation and deactivation of the decrease ΔG of the wide-band gain G.

The noise cancellation controller 34 may preferably cause the full decrease ΔG of the wide-band gain G to amount to about 10 dB or about 6 dB. The noise cancellation controller 34 may preferably cause the full decrease ΔG of the wide-band gain G to a value of at least 3 dB, at least 6 dB or at least 10 dB. The noise cancellation controller 34 may further preferably cause the full decrease ΔG of the wide-band gain G to amount to a value of at most 20 dB or at most 12 dB.

As known in the art, ANC may generally be implemented as feed-backward noise cancellation and/or as feed-forward noise cancellation. In feed-backward noise cancellation earphones, such as the one described above, the noise cancellation signal path 37 is typically part of a closed signal loop that includes an electroacoustic transducer 23 that provides an audio output signal $S_O$, a relatively short acoustic path from a sound-producing element of the electroacoustic transducer 23 to a sound inlet of a reference microphone (the feed-backward microphone 26) that picks up the audio output signal $S_O$ and ambient sound $S_A$ (possibly passively attenuated by structural components of the earphone) and provides a reference signal $S_R$, a noise cancellation filter 32 that filters the reference signal $S_R$ to provide a noise cancellation signal $S_C$ and an output unit 33 that combines the noise cancellation signal $S_C$ with an audio input signal $S_I$ to provide a driving signal S for the electroacoustic transducer 23. In such earphones, the audio output signal $S_O$ often dominates the reference signal $S_R$.

Since in feed-backward noise cancellation earphones and feed-forward noise cancellation earphones, the functional components are quite similar, the figures and the corresponding parts of the description illustrate both types, and in the present application, identical reference numbers and labels are thus used to designate similar components, signals and properties for both types of ANC systems.

In feed-forward noise cancellation earphones, the noise cancellation signal path 37 is typically part of an open signal loop that includes the reference microphone 26, however with a sound inlet arranged with a longer and/or acoustically attenuated acoustic path from the sound-producing element of the electroacoustic transducer 23, e.g. at the outside of the housing 21, so that it primarily picks up ambient sound $S_A$ to provide the reference signal $S_R$, as well as the noise cancellation filter 32 that filters the reference signal $S_R$ to provide a noise cancellation signal $S_C$ and the output unit 33 that combines the noise cancellation signal $S_C$ with the audio input signal $S_I$ to provide the driving signal $S_O$ for the electroacoustic transducer 23. In such earphones, the ambient noise $S_A$ often dominates the reference signal $S_R$ from the reference microphone 26.

In the prior art, various known methods exist for adaptively determining the transfer functions H for the respective noise cancellation filters 32 of feed-backward noise cancellation earphones and feed-forward noise cancellation earphones. The main differences between earphones with feed-backward noise cancellation and earphones with feed-forward noise cancellation lie in the arrangement of the reference microphones 26 and in the methods used for determining the transfer functions H for the noise cancellation filters 32. Even though these differences may present different challenges for the implementation, the teachings of the present application may be applied to both noise cancellation earphone types as well as to combinations hereof.

In some embodiments of the earphone 1 described above, the feed-backward noise cancellation signal path 37 with the feed-backward microphone 26 and the feed-backward noise cancellation filter 32 may thus be replaced with a feed-forward noise cancellation signal path 37 comprising a feed-forward microphone 26 and a feed-forward noise cancellation filter 32, wherein the feed-forward microphone 26 is arranged to primarily pick up ambient sound $S_A$ to provide a feed-forward reference signal $S_R$ in dependence on the picked-up signals and wherein the feed-forward noise cancellation filter 32 applies a feed-forward transfer function H to the feed-forward reference signal $S_R$ to provide a feed-forward noise cancellation signal $S_C$. Correspondingly, the output unit 33 may provide the audio output signal $S_D$ to the electroacoustic transducer 23 by combining the audio input signal $S_I$ and the feed-forward noise cancellation signal $S_C$, and the signal processor 25 may receive the audio input signal $S_I$ and the user input signal $S_U$ from an external device 8 as well as the feed-forward reference signal $S_R$, process these signals and provide the resulting audio output signal $S_D$ to the electroacoustic transducer 23. Furthermore, the noise cancellation controller 34 may adaptively control the feed-forward transfer function H to cause the acoustic output signal $S_O$ to counteract ambient sound $S_A$, such that, with the earphone 1 in the operating position, the level of ambient sound $S_A$ arriving at the ear 5 is reduced while still allowing desired sound, such as music or speech received in the audio input signal $S_I$, to pass through. The feed-forward microphone 26 may thereby function as reference microphone for the for the feed-forward noise cancellation system of the earphone 1.

In some embodiments of the earphone 1 described above, the feed-backward noise cancellation signal path 37 with the feed-backward microphone 26 and the feed-backward noise cancellation filter 32 may be complemented by a feed-forward noise cancellation signal path (not shown) comprising a feed-forward microphone and a feed-forward noise cancellation filter, wherein the feed-forward microphone is arranged to primarily pick up ambient sound $S_A$ to provide a feed-forward reference signal in dependence on the picked-up signals and wherein the feed-forward noise cancellation filter applies a feed-forward transfer function to the feed-forward reference signal to provide a feed-forward noise cancellation signal. Correspondingly, the output unit 33 may provide the audio output signal $S_D$ to the electroacoustic transducer 23 by combining the audio input signal $S_I$, the feed-backward noise cancellation signal $S_C$ and the feed-forward noise cancellation signal, and the signal processor 25 may receive the audio input signal $S_I$ and the user input signal $S_U$ from an external device 8 as well as the feed-backward reference signal $S_R$ and the feed-forward reference signal, process these signals and provide the resulting audio output signal $S_D$ to the electroacoustic transducer 23. Furthermore, the noise cancellation controller 34 may adaptively control feed-backward transfer function H and the feed-forward transfer function to cause the acoustic output signal $S_O$ to counteract ambient sound $S_A$, such that, with the earphone 1 in the operating position, the level of ambient sound $S_A$ arriving at the ear 5 is reduced while still allowing desired sound, such as music or speech received in the audio input signal $S_I$, to pass through. While the feed-backward microphone 26 functions as reference microphone for the feed-backward portion of the noise cancellation system of the earphone 1, the feed-forward microphone may thus function as reference microphone for the for the feed-forward portion of the noise cancellation system of the earphone 1.

In embodiments of the earphone 1 comprising a feed-forward noise cancellation signal path 37, the noise cancellation controller 34 may be adapted to control the wide-band gain G of the feed-forward noise cancellation signal path 37 in the same way as described above for controlling the wide-band gain G of the feed-backward noise cancellation signal path 37—in particular to cause a decrease ΔG of the wide-band gain G of the feed-forward noise cancellation signal path 37 in time periods wherein the total sound level at the ear 5 is below the noise floor level compared to time periods wherein the total sound level at the ear 5 is above the noise floor level. In embodiments of the earphone 1 comprising a feed-forward noise cancellation signal path 37, the level analyzer 35 may provide the sound level estimate $L_S$, based on an analysis of at least one of the audio input signal $S_I$ and the audio output signal $S_O$ and of at least one of the feed-forward reference signal $S_R$ and the feed-forward noise cancellation signal $S_C$ in order to estimate the combined impact of the acoustic output signal $S_O$ and the ambient sound $S_A$.

Similarly, in embodiments of the earphone 1 comprising both a feed-backward noise cancellation signal path 37 and a feed-forward noise cancellation signal path, the noise cancellation controller 34 may be adapted to control either or both of the wide-band gain G of the feed-backward noise cancellation signal path 37 and the wide-band gain of the feed-forward noise cancellation signal path in the way described above.

In some embodiments, the noise cancellation controller 34 may provide the gain control signal $S_G$ to indicate either or both of a decrease ΔG of the wide-band gain G of the feed-backward noise cancellation signal path 37 and a decrease of the wide-band gain of the feed-forward noise cancellation signal path.

In some embodiments of the headset 10, the first earphone 1 may comprise an earphone according to any of the embodiments of an earphone 1 described above. In such embodiments of the headset 10, the second earphone 2 may be omitted.

In some binaural embodiments of the headset 10, each of the first earphone 1 and the second earphone 2 may comprise an earphone according to any of the embodiments of an earphone 1 described above.

In some binaural embodiments of the headset 10, the first earphone 1 may comprise an earphone according to any of the embodiments of an earphone 1 described above, however comprising the transmitter 36 that transmits the gain control signal $S_G$ provided by the noise cancellation controller 34. In such embodiments of the headset 10, the second earphone 2 may comprise an earphone according to any of the embodiments of an earphone 1 described above, however modified to receive the gain control signal $S_G$ from the first earphone 1. In such embodiments of the second earphone 2, some of the above described functional blocks may, however, be omitted and/or have reduced or changed functionality. The second earphone 2 thus comprises at least a housing 21, an electroacoustic transducer 23 suspended in a baffle 24, a signal processor 25, and a reference microphone 26. The signal processor 25 of the second earphone 2 comprises at least an input unit 31, a noise cancellation filter 32, an output unit 33 and a noise cancellation controller 34. In the signal processor 25 of the second earphone 2, the reception of an audio input signal $S_I$ may be omitted. The input unit 31 of the second earphone 2 may thus receive the gain control signal $S_G$ from the first earphone 1 and optionally, a further audio input signal $S_I$, e.g. from the first earphone 1 or from an external device 8. The reference microphone 26 of the second earphone 2 provides a further reference signal $S_R$ in dependence on the picked-up acoustic signals $S_O$, $S_{AR}$. The noise cancellation filter 32 of the second earphone 2 applies a further transfer function H to the further reference signal $S_R$ to provide a further noise cancellation signal $S_C$. The output unit 33 of the second earphone 2 may provide a further audio output signal $S_D$ in dependence on the further noise cancellation signal $S_C$ or by combining the further audio input signal $S_I$ and the further noise cancellation signal $S_C$. The electroacoustic transducer 23 of the second earphone 2 provides a further acoustic output signal $S_O$ in dependence on the further audio output signal $S_D$. The noise cancellation controller 34 of the second earphone 2 adaptively controls the further transfer function H to cause the further acoustic output signal $S_O$ to counteract ambient sound $S_A$, such that, with the second earphone 2 in the operating position, the level of ambient sound $S_A$ arriving at the ear 6 is reduced, while optionally still allowing desired sound, such as music or speech received in the audio input signal $S_I$, to pass through, and further controls the wide-band gain G of the noise cancellation signal path 37 of the second earphone 2 in dependence on the gain control signal $S_G$ received from the first earphone 1 to cause a decrease ΔG of the wide-band gain G of the noise cancellation signal path 37 of the second earphone 2 that is synchronized with the decrease ΔG of the wide-band gain G of the noise cancellation signal path 37 of the first earphone 1. In the signal processor 25 of the second earphone 2, the level analyzer 35 may thus be omitted.

In binaural embodiments of the headset 10, the ANC systems of the first earphone 1 and the second earphone 2 are preferably configured with matching types, meaning that preferably both are feed-backward noise cancellation systems, both are feed-forward noise cancellation systems or both are combined feed-backward/feed-forward noise cancellation systems.

Any of the described devices, e.g. the earphone 1, the first and/or second earphone 1, 2 of the headset 10 and the headset 10 itself, may comprise further structures, functional blocks and/or circuits as readily known in the art, e.g. for further noise filtering, for picking up speech audio from the user 4 and transmitting corresponding audio signals to an external device 8 and/or an external network, for cancelling echoes in such transmitted audio signals and/or for receiving and processing further user input. Signals, such as the audio input signal $S_I$, the user input signal $S_U$, the gain control signal $S_G$ as well as any transmitted audio signals may be transmitted, conveyed and/or received by wired or wireless connections, and any of the described devices may comprise wired or wireless receivers, transmitters and/or transceivers for this and other purposes.

The described devices may be implemented using analog or digital circuits, or mixtures hereof. Functional blocks of digital circuits may be implemented in hardware, firmware or software, or any combination hereof. Digital circuits may perform the functions of multiple functional blocks in parallel and/or in interleaved sequence, and functional blocks may be distributed in any suitable way among multiple hardware units, such as e.g. dedicated signal processors, microcontrollers and other integrated circuits.

The detailed description given herein and the specific examples indicating preferred embodiments of the invention are intended to enable a person skilled in the art to practice the invention and should thus be regarded mainly as an illustration of the invention. The person skilled in the art will be able to readily contemplate further applications of the present invention as well as advantageous changes and modifications from this description without deviating from the scope of the invention. Any such changes or modifications mentioned herein are meant to be non-limiting for the scope of the invention.

The invention is not limited to the embodiments disclosed herein, and the invention may be embodied in other ways within the subject-matter defined in the following claims. As an example, features of the described embodiments may be combined arbitrarily, e.g. in order to adapt devices according to the invention to specific requirements.

Any reference numerals and labels in the claims are intended to be non-limiting for the scope of the claims.

The invention claimed is:

1. An earphone adapted to be arranged in an operating position at a first ear of a user and, in the operating position, provide a first acoustic output signal ($S_O$) to the first ear, the earphone comprising:

a first input unit adapted to receive a first audio input signal ($S_I$);

a first noise cancellation signal path with a first microphone and a first noise cancellation filter wherein the first microphone is arranged to receive ambient sound ($S_A$) from ambient space with the earphone in the operating position and is adapted to provide a corresponding first reference signal ($S_R$), and wherein the first noise cancellation filter is adapted to apply a first transfer function (H) to the first reference signal ($S_R$) to provide a first noise cancellation signal ($S_C$);

a first output unit adapted to provide a first audio output signal ($S_D$) by combining the first audio input signal ($S_I$) and the first noise cancellation signal ($S_C$); and a first electroacoustic transducer adapted to provide the first acoustic output signal ($S_O$) in dependence on the first audio output signal ($S_D$); and a first noise cancellation controller adapted to adaptively control the first transfer function (H) of the first noise cancellation filter to cause the first acoustic output signal ($S_O$) to counteract ambient sound ($S_A$), such that, with the earphone in the operating position, the level of ambient sound ($S_A$) arriving at the first ear is reduced, while still allowing desired sound from the first audio input signal ($S_I$), to pass through, characterized in that:

the earphone further comprises a level adapted to provide, based on an analysis of the first audio input signal ($S_I$) and/or the first reference signal ($S_R$), a sound level estimate ($L_S$) indicating a total sound level at the first ear and to compare the sound level estimate ($L_S$) with a predetermined threshold ($L_T$) indicating a noise floor level;—the first noise cancellation controller further is adapted to, in dependence on the comparison, control the wide-band gain (G) of the first noise cancellation signal path to cause a decrease (ΔG) of the wide-band gain (G) in time periods wherein the total sound level at the first ear is below the noise floor level compared to time periods wherein the total sound level at the first ear is above the noise floor level;

and wherein the level analyzer further is adapted to adjust the indicated noise floor level, with the earphone in the operating position, based on a user input signal ($S_U$) indicating an action of the user, such as e.g. a user input signal ($S_U$) received through a user interface comprised by the earphone or a user input signal ($S_U$) received through a user interface comprised by an external device.

2. An earphone according to claim 1, wherein the level analyzer further is adapted to perform the comparison such that it at least partly compensates for a frequency dependency and/or level dependency of the first ear, e.g. by at least partly compensating for the frequency dependency of the average healthy human ear.

3. An earphone according to claim 2, wherein the predetermined threshold ($L_T$) indicates a noise floor level within a range of 0 dB to 20 dB above the average healthy human hearing threshold, at least within a frequency range from 100 Hz to 1 kHz.

4. An earphone according to claim 1, wherein the predetermined threshold ($L_T$) is determined such that said decrease (ΔG) of the wide-band gain (G) causes a decrease in the noise level perceived by the user.

5. An earphone according to claim 1, wherein the decrease (ΔG) of the wide-band gain (G) is at least 3 dB, at least 6 dB or at least 10 dB.

6. An earphone according to claim 1, wherein the decrease (ΔG) of the wide-band gain (G) is at most 20 dB or at most 12 dB.

7. An earphone according to claim 1 further comprising:

a second noise cancellation signal path with a second microphone and a second noise cancellation filter, wherein the second microphone is arranged to receive ambient sound ($S_A$) from ambient space with the earphone in the operating position and is adapted to provide a corresponding second reference signal ($S_R$), and wherein the second noise cancellation filter is adapted to apply a second transfer function (H) to the second reference signal ($S_R$) to provide a second noise cancellation signal ($S_C$), and wherein:

the output unit further is adapted to provide the audio output signal ($S_D$) by combining the first audio input signal ($S_I$), the first noise cancellation signal ($S_C$) and the second noise cancellation signal ($S_C$);

the noise cancellation controller further is adapted to adaptively control the second transfer function (H) of the second noise cancellation filter to cause the first acoustic output signal ($S_O$) to counteract ambient sound ($S_A$), such that, with the earphone in the operating position, the level of ambient sound ($S_A$) arriving at the first ear is reduced, while still allowing desired sound from the first audio input signal ($S_I$), to pass through;

one of the first and the second noise cancellation signal paths is configured to operate as a feed-forward noise cancellation signal path; and the respective other one of the first and the second noise cancellation signal paths is configured to operate as a feed-backward noise cancellation signal path.

8. An earphone according to claim 1, wherein the first noise cancellation signal path is configured to operate as a feed-forward noise cancellation signal path.

9. An earphone according to claim 1 , wherein the first noise cancellation signal path is configured to operate as a feed-backward noise cancellation signal path.

10. An earphone according to claim 8 wherein the level analyzer further is adapted to provide the sound level estimate ($L_S$) based on an analysis of the first audio output signal ($S_D$).

11. An earphone according to claim 1 , wherein the level analyzer further is adapted to provide the sound level estimate ($L_S$) based on an analysis of at least one of the first audio input signal ($S_I$) and the first audio output signal ($S_D$) and of at least one of the first reference signal ($S_R$) and the first noise cancellation signal ($S_C$).

12. An earphone according to claim 1, wherein the first noise cancellation controller further is adapted to provide a gain control signal ($S_G$) indicating a decrease (ΔG) of the wide-band gain (G) of the first noise cancellation signal path; and wherein the earphone further comprises a transmitter adapted to transmit the gain control signal ($S_G$) to another device.

13. A headset comprising one or two earphones according to claim 1.

14. A headset with a first earphone according to claim 13 and with a second earphone comprising:

a second input unit adapted to receive the gain control signal ($S_G$) from the first earphone;

a third noise cancellation signal path with a third microphone and a third noise cancellation filter, wherein the third microphone is arranged to receive ambient sound ($S_A$) from ambient space with the second earphone in an operating position at a second ear of the user and is adapted to provide a corresponding third reference signal ($S_R$), and wherein the third noise cancellation filter is adapted to apply a third transfer function (H) to the third reference signal ($S_R$) to provide a third noise cancellation signal ($S_C$);

a second output unit adapted to provide a second audio output signal ($S_D$) in dependence on the third noise cancellation signal ($S_C$);

a second electroacoustic transducer adapted to provide a second acoustic output signal ($S_O$) in dependence on the second audio output signal ($S_D$); and a second noise cancellation controller adapted to adaptively control the third transfer function (H) of the third noise cancellation filter to cause the second acoustic output signal ($S_O$) to counteract ambient sound ($S_A$), such that, with the second earphone in the operating position, the level of ambient sound ($S_A$) arriving at the second ear is reduced, and further adapted to control the wide-band gain of the third noise cancellation signal path in dependence on the gain control signal ($S_G$) to cause a decrease of the wide-band gain of the third noise cancellation signal path that is synchronized with the decrease ($\Delta G$) of the wide-band gain (G) of the first noise cancellation signal path of the first earphone.

* * * * *